United States Patent [19]

Pfohl et al.

[11] Patent Number: 4,784,724

[45] Date of Patent: Nov. 15, 1988

[54] MAKING PAPER WHICH HAS A HIGH DRY STRENGTH

[75] Inventors: Sigberg Pfohl, Speyer; Volkmar Weberndoerfer, Mannheim; Heinrich Hartmann, Limburgerhof; Friedrich Linhart, Heidelberg, all of Fed. Rep. of Germany

[73] Assignee: BASF Aktiengesellschaft, Rheinland-Pfalz, Fed. Rep. of Germany

[21] Appl. No.: 852,363

[22] Filed: Apr. 15, 1986

[30] Foreign Application Priority Data

Apr. 26, 1985 [DE] Fed. Rep. of Germany ..... 3515086

[51] Int. Cl.[4] ..... D21H 3/38

[52] U.S. Cl. ..... 162/168.2; 162/135; 162/168.3; 162/168.4; 162/168.5

[58] Field of Search ..... 162/164.6, 168.2, 168.5, 162/168.4, 168.3, 135; 427/389.9, 391

[56] References Cited

U.S. PATENT DOCUMENTS

| | | | |
|---|---|---|---|
| 3,323,980 | 6/1967 | Poschmann et al. | 162/168.2 |
| 3,640,936 | 2/1972 | Williams | 162/168.5 |
| 3,840,489 | 10/1974 | Strazdins . | |
| 3,976,824 | 8/1976 | Ariyoshi et al. | 162/168.5 |
| 4,021,484 | 5/1977 | Toda et al. | 162/168.5 |

FOREIGN PATENT DOCUMENTS

| | | |
|---|---|---|
| 1182826 | 12/1964 | Fed. Rep. of Germany . |
| 3000367 | 7/1981 | Fed. Rep. of Germany . |

*Primary Examiner*—Peter Chin

*Attorney, Agent, or Firm*—Oblon, Fisher, Spivak, McClelland & Maier

[57] ABSTRACT

Paper having a high dry strength is made using water-soluble homopolymers of salts or quaternary 1-vinyl-2-imidazolines and copolymers of these salts or quaternary compounds with acrylamide and/or methacrylamide as agents for increasing the dry strength of paper.

2 Claims, No Drawings

MAKING PAPER WHICH HAS A HIGH DRY STRENGTH

To increase the dry strength of the paper, both natural and synthetic products have long been used in practice. Natural products, such as starch, carboxymethylcellulose or mannogalactanes, have many disadvantages when added to the stock suspension. Particularly in closed circulation systems, they are not very effective, give a wastewater having a high COD and BOD (chemical and biological oxygen demand) and furthermore have an adverse effect on drainage of the paper stock. Among the synthetic products, the conventional wet-strength resins based on urea and formaldehyde, melamine and formaldehyde or polyamidoamine and epichlorohydrin can only be used in exceptional cases because they cause difficulties when rejects are being worked up.

Synthetic products, such as polymers based on acrylamide, are disclosed in, for example, German Laid-Open Application DOS No. 3,000,367, as agents for providing paper with dry strength. The nonionic polymers and acrylic acid-modified anionic polymers of acrylamide are virtually completely ineffective under the conventional manufacturing conditions, while the amphoteric and cationic polyacrylamides are effective dry-strength products for paper only in the case of open circulation systems and for bleached pulps and as a rule only in the presence of aluminum sulfate.

The cationic polyacrylamides generally contain from 70 to 80% by weight of acrylamide and from 20 to 30% by weight of a cationic monomer as copolymerized units. By incorporating hydrophobic components in the copolymer, an attempt was made to improve the affinity of the cationic polyacrylamides to fibers (cf. for example U.S. Pat. No. 3,840,489). The cationic polyacrylamides currently available on the market are effective only for bleached pulps and with open circulations in paper machines. When paper stock based on waste paper is processed at a neutral pH and with closed water circulations, the effectiveness of the cationic polyacrylamides is very adversely affected by the high content of interfering substances in the system. Examples of interfering substances are humic acids, ligninsulfonates, starch degradation products and cellulose degradation products. High water hardness and a high acidity of the paper stock often has a very disadvantageous effect on the process for imparting dry strength to paper.

German Published Application DAS No. 1,182,826 discloses a process for the preparation of cationic polymers, in which, inter alia, 1-vinyl-2-imidazolines, in the form of the free bases, of the salts with inorganic or organic acids or of the quaternization products, alone or as a mixture with other ethylenically unsaturated monomers, are polymerized in a conventional manner. Copolymers of acrylamide and vinylmethylimidazoline, which are recommended, for example, as flocculents or as thickeners for cationic polymer dispersions, are particularly noteworthy.

It is an object of the present invention to provide a polymer for making paper which has a high dry strength, which polymer shows virtually no tendency to foaming under the processing conditions and, when added to the paper stock, exhibits only slight sensitivity to interfering substances.

We have found that this object is achieved, according to the invention, if water-soluble homopolymers of compounds of the formula

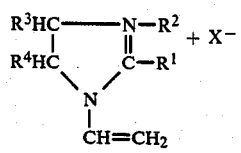

(I)

where $R^1$ is H, $C_1$–$C_{18}$-alkyl or

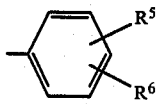

$R^5$ and $R^6$ are each H, $C_1$–$C_4$-alkyl or Cl, $R^2$ is H, $C_1$–$C_{18}$-alkyl,

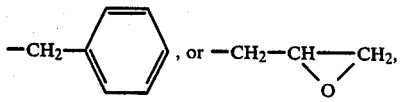

$R^3$ and $R^4$ are each H or $C_1$–$C_4$-alkyl and $X^-$ is an acid radical, and/or water-soluble copolymers which contain, as copolymerized units (a) not less than 1% by weight of a compound of the formula I and (b) acrylamide and/or methacrylamide, the K value of the homopolymers and copolymers being from 50 to 250, are used as the cationic polymers.

The novel use of homopolymers and copolymers of compounds of the formula I gives dry-strength agents which are very effective and at the same time possess little sensitivity to the interfering substances in water circulations in paper mills. The products used according to the invention are particularly effective at a neutral pH. It is surprising that a high level of effectiveness is achieved even if a small amount of the cationic compound is combined with acrylamide and/or methacrylamide, for example from 2 to 15% by weight of compounds of the formula I. Since, in order to prepare effective dry-strength agents, only small amounts of cationic monomers (compounds of the formula I) are copolymerized with acrylamide, the acrylamide copolymers used according to the invention are substantially more economical than the conventional acrylamide polymers modified with a large amount of expensive cationic monomers.

The water-soluble homopolymers and copolymers of 1-vinyl-2-imidazoline salts are prepared by the process described in German Published Application DAS No. 1,182,826, by polymerizing a compound of the formula I with or without acrylamide and/or methacrylamide, in an aqueous medium at a pH of from 0 to 8, preferably from 1.0 to 6.8, in the presence of a polymerization initiator which decomposes to give free radicals. Compared with conventional paper auxiliaries, the aqueous solutions have the advantage that they have virtually no tendency to foam. In the polymerization, 1-vinyl-2-imidazoline salts of the formula II

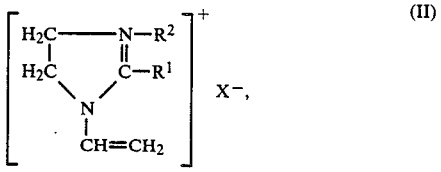

(II)

where $R^1$ is H, $CH_3$, $C_2H_5$, n- or iso-$C_3H_7$ or $C_6H_5$, $X^-$ is an acid radical, preferably $Cl^-$, $Br^-$, $SO_{42}$-, $CH_3O—SO_3H^-$, $C_2H_5—O—SO_3H^-$ or $R—COO^-$ and $R^2$ is H, $C_1$–$C_4$-alkyl or aryl, are preferably employed.

In formulae I and II, $X^-$ can in principle be any radical of an inorganic or organic acid. The monomers of the formula I are prepared by neutralizing the free base, ie. a 1-vinyl-2-imidazoline, with an equivalent amount of an acid. Vinylimidazolines may also be neutralized with, for example, trichloroacetic acid, benzenesulfonic acid or toluenesulfonic acid. Apart from salts of 1-vinyl-2-imidazolines, quaternized 1-vinyl-2-imidazolines are also suitable. They are prepared by reacting 1-vinyl-2-imidazolines, which are unsubstituted or substituted in the 2-, 4- or 5-position, with a conventional quaternizing agent. Examples of suitable quaternizing agents are $C_1$–$C_{18}$-alkyl chlorides and bromides, benzyl chloride, benzyl bromide, epichlorohydrin, dimethyl sulfate and diethyl sulfate. Preferably used quaternizing agents are epichlorohydrin, benzyl chloride, dimethyl sulfate and methyl chloride.

To prepare the water-soluble homopolymers, the compounds of the formula I (also referred to below as monomers of group (a)) are polymerized, preferably in an aqueous medium. The copolymers are obtained by polymerizing the monomers of group (a) with the monomers of group (b), ie. acrylamide and/or methacrylamide. The monomer mixture used for the polymerization contains not less than 1% by weight of a monomer of group (a) where copolymers are being prepared.

The copolymers may be further modified by incorporating monomers of group (c), such as styrene, vinyl acetate, acrylates, methacrylates, ethylenically unsaturated $C_3$–$C_5$-carboxylic acids, sodium vinylsulfonate, acrylonitrile, methacrylonitrile, vinyl chloride or vinylidene chloride, as copolymerized units, in amounts of up to 25% by weight. Amphoteric copolymers, for example copolymers of acrylamide, from 2 to 30% by weight of a compound of the formula I and from 2 to 25% by weight of acrylic acid, are also suitable as dry-strength agents for paper.

The homopolymers and copolymers of compounds of the formula I can be prepared by various polymerization methods. For example, the compounds of the formula I, in an aqueous solution, may be polymerized alone or subjected to copolymerization together with the monomers of group (b). The monomer concentration for the solution polymerization in water is from 1 to 70% by weight.

The monomers of group (a) may furthermore be polymerized in a water-in-oil emulsion by the process disclosed in German Pat. No. 1,089,873, with or without the monomers (b). This process gives polymer dispersions. In another possible method of preparing the water-soluble homopolymers or copolymers of compounds of the formula I, the monomers are polymerized by the inverse suspension polymerization method as described in German Pat. No. 1,081,228. This process gives bead polymers.

The polymerization is initiated with the aid of conventional polymerization initiators or by the action of high-energy radiation, eg. electron beams, UV radiation or gamma radiation. The polymerization initiators decompose into free radicals under the polymerization conditions. Examples of suitable polymerization initiators are hydrogen peroxide, inorganic and organic peroxides and hydroperoxides, and azo compounds. Preferably used polymerization initiators are those which are partially or completely soluble in water, eg. potassium peroxydisulfate or redox catalysts, such as potassium bromate/bisulfite or azo compounds, such as 2,2'-azobis-(2-amidinopropane)dihydrochloride, 2,2'-azobis-(N,N'-dimethyleneisobutyramidine)dihydrochloride or 2,2'-azobis-(2,4-dimethylvaleronitrile). The polymerization initiators which are used in each case in the polymerization are selected so that they decompose into free radicals at the particular polymerization temperature. Both mixtures of polymerization initiators and redox polymerization catalysts, eg. sodium sulfite/ammonium persulfate/sodium bromate, sodium sulfite/ascorbic acid/potassium peroxydisulfate, hydrogen peroxide/iron(II) salts and potassium peroxydisulfate/iron(II) salts, can be used.

The polymerization is carried out at from 0° to 100° C., preferably from 15° to 80° C. It is of course also possible to effect polymerization at temperatures higher than 100° C., but in this case the procedure has to be carried out under superatmospheric pressure. For example, temperatures up to 150° C. are possible. The reaction time depends on the temperature. The higher the temperature during the polymerization, the shorter is the time required for the polymerization. For example, the polymerization takes about 500 hours at 0° C., whereas the reaction at a polymerization temperature of 100° C. is only a few minutes, eg. 5 minutes.

Since the preparation of the compounds of the formula I is relatively expensive, for economic reasons paper is provided with dry strength using, preferably, copolymers of (meth)acrylamide which contain only effective amounts of compounds of the formula I as copolymerized units, eg. from 1 to 30% by weight. It is of course also possible to use (meth)acrylamide copolymers which contain up to 99% of compounds of the formula I as copolymerized units, but these highly cationic polymers are more expensive than the (meth)acrylamide copolymers cationically modified to only a small extent. Copolymers of acrylamide with compounds of the formula I, where $R^1$ is methyl, $R^2$, $R^3$ and $R^4$ are each H and X is an acid radical, preferably chloride or sulfate, are preferably used as dry-strength agents for paper. The acrylamide copolymers contain from 1 to 30, preferably from 5 to 20, % by weight of one or more cationic monomers of the formula I. The homopolymers and copolymers are used, according to the invention, in an amount of from 0.05 to 3.0, preferably from 0.1 to 0.5, % by weight, based on the weight of the dry paper fibers, as dry-strength agents for paper. Preferably, the polymers are added to the paper stock. The polymers used according to the invention are added to the fiber suspension under the conditions conventionally employed in papermaking. Even in the case of closed circulations in paper machines, the interfering substances present in the system do not have a very adverse effect on the effectiveness of the polymers used according to the invention. The polymers can be used for making any known grade of paper or board, for example writing papers, printing papers and packaging papers. The papers may be made from a large variety of fiber materials, for example from sulfite or sulfate pulp in the bleached or unbleached state, groundwood or waste paper. The pH of the stock suspension is from 4 to 9, preferably from 6 to 8. The polymers used according to the invention may also be applied onto the surface of the preformed paper, for example in the size press. The K value of the polymers may vary within a wide range, for example from 50 to 250, preferably from 100 to 150 (Fikentscher K value, measured on a 0.5% strength polymer solution in 5% strength aqueous sodium chloride solution at 20° C.).

The paper has an increased strength immediately after it has been dried under the conventional conditions, for example at from 80° to 110° C. It is not necessary to age the paper in order to achieve this. Compared with untreated paper, the paper treated according to the invention has a markedly improved strength, which can be determined quantitatively, for example, on the basis of the tear length, the bursting pressure, the Dennison value, the tear strength and the CMT value.

In the Examples, parts and percentages are by weight.

The sheets were produced in a Rapid-Köthen laboratory sheet former. The dry tear length was determined according to DIN 53,112, sheet 1, the bursting pressure by the Mullen method (DIN 53,141), the CMT value according to DIN 53,143 and the Dennison value using the standardized wax rods.

Testing was carried out after the sheets had been conditioned for 24 hours at 23° C. and a relative humidity of 50%.

The K value of the polymers was determined according to H. Fikentscher, Cellulose-chemie 13 (1932), 58–64 and 71–74, at 20° C. in 5% strength aqueous sodium chloride solution at a polymer concentration of 0.5% by weight; $K=k.10^3$. The polymers 1 to 3 were prepared by the process described in German Published Application DAS No. 1,182,826, by polymerization of the particular monomers in aqueous solution.

POLYMER 1

10.0% strength aqueous solution of a copolymer of 90 parts of acrylamide and 10 parts of 2-methyl-1-vinylimidazoline, having a K value of 135 and neutralized with hydrochloric acid.

POLYMER 2

10% strength aqueous solution of a copolymer of 85 parts of acrylamide and 15 parts of 1-vinylimidazoline, having a K value of 120 and neutralized with formic acid.

POLYMER 3

10% strength aqueous solution of a copolymer of 95 parts of acrylamide and 5 parts of 2-vinylimidazoline, having a K value of 200 and neutralized with sulfuric acid.

POLYMER 4

(Comparison, described in U.S. Pat. No. 3,840,489)

A copolymer of acrylamide and styrene in a molar ratio of 89:11 was prepared by the method given in Example 1 of U.S. Pat. No. 3,840,489.

POLYMER 5

(Comparison, described in German Laid-Open Application DOS No. 3,000,367)

Copolymer of 80% of acrylamide and 20% of diethylaminoethyl acrylate, neutralized with hydrochloric acid and having a K value of 110 (prepared by polymerization of the monomers in aqueous solution).

POLYMER 6

(Comparison, described in German Laid-Open Application DOS No. 3,000,367)

Copolymer of 90% of acrylamide and 10% of diethylaminoethyl acrylate, neutralized with sulfuric acid and having a K value of 150 (prepared by copolymerization of the monomers in aqueous solution).

EXAMPLE 1

A 0.5% strength aqueous stock suspension is prepared from 100% mixed waste paper. The pH of the suspension was 7.2 and its freeness was 50° Schopper-Riegler (°SR). The stock suspension was then divided into three equal parts and processed under the conditions described under (a) to (c) to give sheets having a weight per unit area of 120 g/m$^2$.

In (a), sheet formation was carried out without the addition of an auxiliary, whereas in (b), 0.2%, based on dry fiber, of polymer 4 was added and in (c) 0.2%, based on dry fiber, of polymer 1 was added. The CMT value and the dry bursting pressure of the sheets produced under (a) to (c) were measured. The results are shown in Table 1.

TABLE 1

| Example 1 | CMT value (N) | Dry bursting pressure (kpa) |
|---|---|---|
| (a) Comparison | 115 | 105 |
| (b) Comparison | 155 | 120 |
| (c) According to the invention | 170 | 135 |

EXAMPLE 2

A 0.5% strength aqueous stock suspension was prepared from 50% of groundwood and 50% of a bleached softwood sulfite pulp. The pH of the suspension was 7.5 and the freeness was 50° SR. The stock suspension prepared in this manner was divided into three equal parts and processed under the conditions stated under (a) to (c) to give sheets having a weight per unit area of 80 g/m$^2$. In (a), sheets were prepared without any further additives, whereas in (b) 0.3%, based on dry fiber, of polymer 5 was added and in (c) 0.3%, based on dry fiber, of polymer 2 was added. For the sheets obtained in (a) to (c), the dry tear length and the dry bursting pressure were measured in each case and the Dennison test was carried out. The results are shown in Table 2.

TABLE 2

| Example 2 | Dry tear Length (m) | Dry bursting pressure (kpa) | Dennison values Top side | Dennison values Wire side |
|---|---|---|---|---|
| (a) Comparison | 3250 | 145 | 3 | 7 |
| (b) Comparison | 3440 | 150 | 4 | 7 |
| (c) According to the invention | 3610 | 165 | 6 | 9 |

EXAMPLE 3

A 0.5% strength aqueous stock suspension having a pH of 7.2 and a freeness of 50° SR was prepared from 100% waste paper. To demonstrate the low sensitivity to interfering substances of the polymers used according to the invention, a hot-water extract of spruce chips were added to the stock suspension. This hot-water extract was obtained by treating 500 g of spruce turnings for 2 hours in 10 l of water at 100° C. The wood extract, which contained about 1 g/l of dry residue, was evaporated to dryness in a rotary evaporator.

10%, based on beaten waste paper, of the solid extract were added to the above stock suspension obtained from waste paper, and the mixture was divided into 4 parts. The sheets having a weight per unit area of 120 g/m$^2$ were produced under the conditions stated in (a) to (d). In (a), sheet formation was carried out without any further additives, in (b) 0.5% of polymer 6 was used to increase the dry strength of the paper, in (c) 2%, based on dry fiber, of a commercial cationic starch was added, and in (d) 0.5%, based on dry fiber, of the dry-strength agent according to the present invention (polymer 3) was added. The dry bursting pressure was then determined for all four paper sheets. The results are shown in Table 3.

TABLE 3

| Experiment | Dry bursting pressure (kpa) |
|---|---|
| (a) Comparison | 85 |
| (b) Comparison | 95 |
| (c) Comparison | 105 |
| (d) according to the invention | 120 |

We claim:

1. A process for making paper which has a high dry strength by adding a cationic copolymer to the paper stock and draining the latter with sheet formation, or by applying a cationic copolymer onto the surface of paper, the said copolymer being added in an amount of from 0.05 to 3.0% by weight, based on dry fiber or dry paper, wherein a water-soluble copolymer of 2 to 15% by weight of a compound of the formula

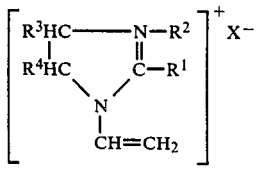

(I)

where $R^1$ is $CH_3$, $R^2$, $R^3$ and $R^4$ are each H, and $x^-$ is an acid radical, and from 98 to 85% by weight of acrylamide, methacrylamide or mixtures thereof, the K value of the copolymer being from 50 to 250.

2. The process of claim 1 wherein the K value of the copolymer is from 100 to 150.

* * * * *